US007911464B2

(12) United States Patent
Childs et al.

(10) Patent No.: US 7,911,464 B2
(45) Date of Patent: Mar. 22, 2011

(54) ELECTROLUMINESCENT DISPLAY DEVICES

(75) Inventors: Mark J. Childs, Sutton (GB); Alan G. Knapp, Crawley (GB); David A. Fish, Haywards Heath (GB); Nigel D. Young, Redhill (GB)

(73) Assignee: Koninklijke Philips Electronics N.V., Eindhoven (NL)

( * ) Notice: Subject to any disclaimer, the term of this patent is extended or adjusted under 35 U.S.C. 154(b) by 1147 days.

(21) Appl. No.: 10/566,758

(22) PCT Filed: Jul. 30, 2004

(86) PCT No.: PCT/IB2004/002582

§ 371 (c)(1),
(2), (4) Date: Jan. 31, 2006

(87) PCT Pub. No.: WO2005/015530

PCT Pub. Date: Feb. 17, 2005

(65) Prior Publication Data

US 2009/0243498 A1 Oct. 1, 2009

(30) Foreign Application Priority Data

Aug. 8, 2003 (GB) ..... 0318613.7
Mar. 16, 2004 (GB) ..... 0405804.6

(51) Int. Cl.
*G09G 5/00* (2006.01)

(52) U.S. Cl. ..... 345/214; 345/211; 345/212; 345/82; 345/102

(58) Field of Classification Search ..... 315/169.1, 315/169.3; 345/82, 76–78, 46, 214, 211, 345/212

See application file for complete search history.

(56) References Cited

U.S. PATENT DOCUMENTS

| | | | | |
|---|---|---|---|---|
| 6,320,325 | B1 | 11/2001 | Cok et al. | |
| 6,424,326 | B2 * | 7/2002 | Yamazaki et al. | 345/77 |
| 7,456,812 | B2 * | 11/2008 | Smith et al. | 345/82 |
| 2001/0055008 | A1 | 12/2001 | Young et al. | |
| 2002/0171611 | A1 | 11/2002 | Cok | |
| 2002/0175885 | A1 | 11/2002 | Cok | |
| 2003/0142047 | A1 | 7/2003 | Inoue et al. | |

FOREIGN PATENT DOCUMENTS

| | | | |
|---|---|---|---|
| EP | 0717446 | A2 | 6/1996 |
| EP | 1 096 466 | A1 | 5/2001 |
| EP | 1194013 | A1 | 4/2002 |
| GB | 2381644 | A | 10/2001 |
| JP | 2002169511 | A | 6/2002 |
| WO | WO 96-36959 | | 11/1996 |
| WO | WO 01/20591 | A1 | 3/2001 |

* cited by examiner

*Primary Examiner* — Tuyet Thi Vo

(57) ABSTRACT

The pixels of an active matrix display device have a current-driven light emitting display element, a drive transistor for driving a current through the display element, a storage capacitor for storing a pixel drive voltage to be used for addressing the drive transistor, a light-dependent device for detecting the brightness of the display element, and driver circuitry for providing data signals to the pixel external to the pixel array. This provides a pixel with optical feedback to compensate for display element ageing. The driver circuitry has a processing means for processing the feedback brightness signals and derives from them a threshold voltage for the drive transistor of the pixel as well as information relating to the performance of the display element, for ageing compensation.

36 Claims, 6 Drawing Sheets

ELECTROLUMINESCENT DISPLAY DEVICES

This invention relates to electroluminescent display devices, particularly active matrix display devices having an array of pixels comprising light-emitting electroluminescent display elements and thin film transistors. More particularly, but not exclusively, the invention is concerned with an active matrix electroluminescent display device whose pixels include light sensing elements which are responsive to light emitted by the display elements and used in the control of energisation of the display elements.

Matrix display devices employing electroluminescent, light-emitting, display elements are well known. The display elements commonly comprise organic thin film electroluminescent elements, (OLEDs), including polymer materials (PLEDs), or else light emitting diodes (LEDs). These materials typically comprise one or more layers of a semiconducting conjugated polymer sandwiched between a pair of electrodes, one of which is transparent and the other of which is of a material suitable for injecting holes or electrons into the polymer layer.

The display elements in such display devices are current driven and a conventional, analogue, drive scheme involves supplying a controllable current to the display element. Typically a current source transistor is provided as part of the pixel configuration, with the gate voltage supplied to the current source transistor determining the current through the electroluminescent (EL) display element. A storage capacitor holds the gate voltage after the addressing phase. An example of such a pixel circuit is described in EP-A-0717446.

Each pixel thus comprises the EL display element and associated driver circuitry. The driver circuitry has an address transistor which is turned on by a row address pulse on a row conductor. When the address transistor is turned on, a data voltage on a column conductor can pass to the remainder of the pixel. In particular, the address transistor supplies the column conductor voltage to the current source, comprising the drive transistor and the storage capacitor connected to the gate of the drive transistor. The column, data, voltage is provided to the gate of the drive transistor and the gate is held at this voltage by the storage capacitor even after the row address pulse has ended. The drive transistor in this circuit is implemented as a p-channel TFT, (Thin Film Transistor) so that the storage capacitor holds the gate-source voltage fixed. This results in a fixed source-drain current through the transistor, which therefore provides the desired current source operation of the pixel. The brightness of the EL display element is approximately proportional to the current flowing through it.

In the above basic pixel circuit, differential ageing, or degradation, of the LED material, leading to a reduction in the brightness level of a pixel for a given drive current, can give rise to variations in image quality across a display. A display element that has been used extensively will be much dimmer than a display element that has been used rarely. Also, display non-uniformity problems can arise due to the variability in the characteristics of the drive transistors, particularly the threshold voltage level.

Improved voltage-addressed pixel circuits which can compensate for the ageing of the LED material and variation in transistor characteristics have been proposed. These include a light sensing element which is responsive to the light output of the display element and acts to leak stored charge on the storage capacitor in response to the light output so as to control the integrated light output of the display element during the drive period which follows the initial addressing of the pixel. Examples of this type of pixel configuration are described in detail in WO 01/20591 and EP 1 096 466. In an example embodiment, a photodiode in the pixel discharges the gate voltage stored on the storage capacitor and the EL display element ceases to emit when the gate voltage on the drive transistor reaches the threshold voltage, at which time the storage capacitor stops discharging. The rate at which charge is leaked from the photodiode is a function of the display element output, so that the photodiode serves as a light-sensitive feedback device.

With this arrangement, the light output from a display element is independent of the EL display element efficiency and ageing compensation is thereby provided. Such a technique has been shown to be effective in achieving a high quality display which suffers less from non-uniformities over a period of time. However, this method requires a high instantaneous peak brightness level to achieve adequate average brightness from a pixel in a frame time and this is not beneficial to the operation of the display as the LED material is likely to age more rapidly as a result.

In an alternative approach proposed by the applicant, the optical feedback system is used to change the duty cycle with which the display element is operated. The display element is driven to a fixed brightness, and the optical feedback is used to trigger a transistor switch which turns off the drive transistor rapidly. This avoids the need for high instantaneous brightness levels, but introduces additional complexity to the pixel.

There have been other refinements proposed to this kind of voltage addressed pixel circuit, for example as described in British Patent Application No 0305632.2 (PHGB 030025) to correct as well for the effects of stress induced threshold voltage variations in the drive transistors which supply current to the EL elements of the pixels, allowing the possibility of amorphous silicon TFTs to be used for the drive transistors.

A problem with these pixel circuits is that they add increasing complexity to the pixel circuit and require more components for the pixel circuit which makes high resolution display more difficult to fabricate.

According to the invention, there is provided an active matrix display device comprising an array of display pixels, each pixel comprising:

a current-driven light emitting display element;

a drive transistor for driving a current through the display element;

a storage capacitor for storing a pixel drive voltage to be used for addressing the drive transistor;

a light-dependent device for detecting the brightness of the display element; and driver circuitry for providing data signals to the pixel external to the pixel array, wherein the driver circuitry further comprises processing means for processing brightness signals from the light-dependent devices of each pixel, wherein the processing means is adapted to derive from a plurality of different brightness signals from each pixel a threshold voltage for the drive transistor of the pixel and information relating to the performance of the display element.

In this arrangement, the processing of brightness signals is provided in the driver circuitry, and this processing is not only for deriving an ageing compensation scheme, but also for obtaining the drive transistor threshold voltage. The pixel circuit is thus simplified by transferring at least some of the complexity of the pixel circuit to the drive circuit for the array of pixels, so that the pixel circuit comprises substantially only those elements essential to its operation. In this way more complex circuits are accommodated in the drive circuit, preferably the column drive circuit, and not in the pixels themselves.

The brightness signals are preferably in the form of a quantity of charge stored on a capacitor associated with the light dependent device. The information relating to the performance of the display element preferably comprises a parameter which takes account of the display element efficiency and the drive transistor mobility.

Each pixel may further comprise a sense transistor for controlling the coupling of the light-dependent device to a sense line. The light dependent device may be connected in series with the sense transistor between a power supply line and a sense line.

The driver circuitry is preferably operable during a setup process to drive the display elements of each pixel to a plurality of different predetermined drive levels, and the processing means is operable to process brightness signals from the light-dependent devices of each pixel for each of the plurality of different predetermined drive levels.

The analysis of the brightness signals for a number of different uniform images then enables the threshold voltage to be determined as well as the ageing/mobility parameter. The setup process may involve driving the display elements of each pixel to an off state, a full brightness state and an intermediate state. Each pixel may be driven to these different levels twice, and difference data is then derived from pairs of data for each pixel for each of the plurality of different predetermined drive levels. This enables compensation for leakage currents.

Further difference data may then be obtained from the difference data in order to compensate for ambient illumination of the light dependent devices.

During use of the display, a reset operation can be performed of the light dependent device of a pixel or row of pixels, and brightness signals from the light-dependent devices of the pixel or row of pixels are obtained at a later time. The information is thus obtained in a two stage process. During set-up, a full sensing operation is carried out, and all parameters are determined. During use of the display, some of these parameters can be assumed constant, for example the threshold voltage of polysilicon transistors or a photodiode efficiency. During use, a simpler sensing operation can be carried out so that only the variable parameters are updated.

During use, charge can be allowed to build up, and measurement is only taken shortly before the light dependent device of a pixel or of a pixel in the row reaches a saturation condition. This may be a plurality of frames after the reset operation, so that the number of read out operations is kept to a minimum and the signal to be eventually measured can be made large.

The device may further comprise a memory structure having a first memory area for storing threshold voltage information for the drive transistor of each pixel and having a second memory area for storing ageing/mobility information for each pixel.

In a preferred embodiment of the present invention, a pixel circuit includes an EL display element, a current source (drive transistor), a memory element, and a switch allowing the pixel to be addressed with a data signal, these components providing a conventional, basic, active matrix pixel circuit and the minimum required for active matrix operation. The circuit then may further include a photosensitive device, for example a photodiode or phototransistor, an associated memory element (capacitor) and a further switch. The photosensitive element senses the brightness of the EL display element which is converted to an electrical charge indicative of the brightness level and stored in the pixel, by means of the associated memory element. This charge can be read-out from the pixel at some subsequent time, enabling the brightness of the pixel for a given data signal voltage level to be determined. This information can then be used to adjust the input data signal voltages supplied to each pixel so as to correct for varying TFT threshold voltage and mobility and the EL display element efficiency. This correction can be performed in the drive circuit outside the pixel array, preferably within the column drive circuitry supplying the data signals to the pixels.

In another preferred embodiment, each pixel additionally includes another switch for controlling the energisability of the display element, and involves sharing of addressing (selection) and data signal lines with a view to maximizing pixel apertures.

The invention also provides a method of driving an active matrix display device comprising an array of display pixels each comprising a drive transistor, a current-driven light emitting display element and a light-dependent device for detecting the brightness of the display element, the method comprising:

driving the display elements of each pixel to a plurality of different predetermined drive levels, and processing brightness signals from the light-dependent devices of each pixel for each of the plurality of different predetermined drive levels; and deriving threshold voltage and information relating to the performance of the display element from the brightness signals.

Other aspects of the method of the invention are outlined above.

Advantageous features in accordance with the present invention are illustrated specifically in embodiments of various aspects of the present invention now to be described, by way of example, with reference to the accompanying drawings, in which.

The same reference numbers are used throughout the Figures to denote the same or similar parts.

Figure 1:
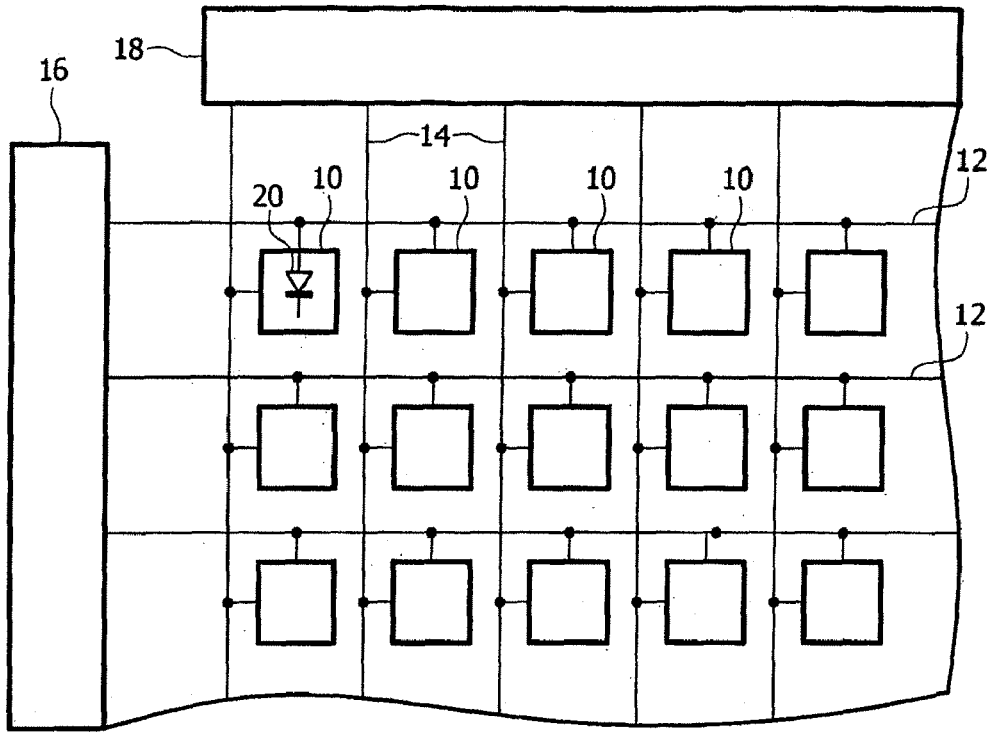
FIG. 1 is a simplified schematic diagram of an embodiment of active matrix EL display device.

Referring to FIG. 1, the active matrix EL display device comprises a panel having a row and column matrix array of regularly—spaced pixels, denoted by the blocks 10, each comprising an EL display element 20 and an associated driving circuit controlling the current through the display element. The pixels are located at the intersections between crossing sets of row (selection) and column (data) address conductors, or lines, 12 and 14. Only a few pixels are shown here for simplicity. The pixels 10 are addressed via the sets of address conductors by a peripheral drive circuit comprising a row, scanning, driver circuit 16 and a column, data, driver circuit 18 connected to the ends of the respective conductor sets.

Each row of pixels is addressed in turn in a frame period by means of a selection pulse signal applied by the circuit 16 to the relevant row conductor 12 so as to program the pixels of the row with respective data signals which determine their individual display outputs in a frame period that follows the address period, the data signals being supplied in parallel by the circuit 18 to the column conductors 14. As each row is addressed, the data signals are supplied by the circuit 18 in appropriate synchronisation.

The EL display element 20 of each pixel comprises an organic light emitting diode, represented here as a diode element (LED), and comprising a pair of electrodes between which one or more active layers of organic electroluminescent light-emitting material are sandwiched. In this particular embodiment the material comprises a polymer LED material, although other organic electroluminescent materials, such as low molecular weight materials, could be used. The display elements of the array are carried, together with their associated active matrix circuitry, on the surface of an insulating substrate. The substrate is of transparent material, for example glass, and either the cathodes or anodes of the display elements 20 are formed of a transparent conductive material, such as ITO, so that light generated by the electroluminescent layer is transmitted through these electrodes. Typical examples of suitable organic conjugated polymer materials which can be used for the EL material are described in WO 96/36959. Typical examples of other, low molecular weight, organic materials are described in EP-A-0717446.

The driving circuit of each pixel 10 includes a drive transistor, comprising a low temperature polysilicon TFT (thin film transistor), which is responsible for controlling the current through the display element 20 on the basis of a data signal voltage applied to the pixel via a column conductor 14 which is shared by a respective column of pixels. The column conductor 14 is coupled to the gate of the current-controlling drive TFT through an address TFT in the pixel driving circuit and the gates for the address TFTs of a row pixels are all connected to a respective, common, row address conductor 12.

Although not shown in FIG. 1, each row of pixels 10 also shares, in conventional manner, a respective power supply line held at a predetermined voltage, and a reference potential line, usually provided as a continuous electrode common to all pixels. The display element 20 and the drive TFT are connected in series between the power supply line and the common reference potential line. The reference potential line, for example, may be at ground potential and the power supply line at a positive potential around, for example, 12V with respect thereto.

The features of the display device described thus far are generally similar to those of known devices.

Figure 2:
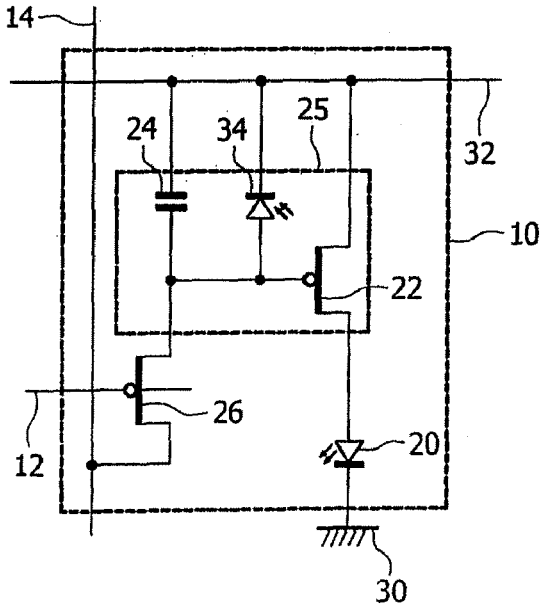
FIG. 2 Prior Art
FIG. 2 illustrates a known form of pixel circuit.

FIG. 2 illustrates a known form of pixel circuit, as described in WO 01/20591 for example. Here the drive TFT and the address TFT, both comprising p-channel devices, are referenced at 22 and 26 respectively, and the power supply line and reference potential line are referenced at 32 and 30 lo respectively. When the address TFT 26 is turned on in a respective row address period by a selection pulse signal applied to the row conductor 12, a voltage (data signal) on the column conductor 14 can pass to the remainder of the pixel. In particular, the TFT 26 supplies the column conductor voltage to a current source circuit 25 comprising the drive TFT 22 and a storage capacitor 24 connected between the gate of the TFT 22 and the power supply line 32. Thus, the column voltage is provided to the gate of the TFT 22 which is held at this voltage, constituting a stored control value, by the storage capacitor 24 even after the address TFT 26 is turned off at the end of the row address period. The drive TFT 22 is here implemented as a P-channel TFT and the capacitor 24 holds the gate—source voltage. This results in a fixed source—drain current through the TFT 22, which therefore provides the desired current source operation of the pixel. Electrical current through the display element 20 is regulated by the drive TFT 22 and is a function of the gate voltage on the TFT 22, which is dependent upon the stored control value determined by the column voltage, data, signal. At the end of the row address period, the voltage retained by the storage capacitor 24 maintains the operation of the display element during the subsequent drive period before the pixel is addressed again in the next frame period. The voltage between the gate of the TFT 22 and the reference potential line 32 thus determines the current passing through the display element 20, and in turn controls the instantaneous light output level of the pixel.

The known pixel circuit of FIG. 2 further includes a discharge photodiode 34, which is reverse biased and responsive to light emitted by the display element 20 and acts to decay the charge stored on the storage capacitor 24 in dependence on light emitted by the element 20, via the photocurrent generated in the photodiode. The photodiode discharges the gate voltage stored on the capacitor 24 and when the gate voltage on the TFT 22 reaches the TFT's threshold voltage the display element 20 will no longer emit light and the storage capacitor stops discharging. The rate at which charge is leaked from the photodiode 34 is a function of the display element lo light output level so that the photodiode 34 functions as a light sensitive feedback device.

The photodiode feedback arrangement is used to compensate for the degradational effects of display element ageing, whereby the efficiency of its operation in terms of the light output level produced for a given drive current diminishes. Through such degradation display elements that have been driven longer and harder will exhibit reduced brightness, causing display non-uniformities. The photodiode arrangement counteracts these effects by appropriately controlling the integrated, total, light output from a display element in the drive period, corresponding to a frame period at maximum. The length of time for which a display element is energized to generate light during the drive period which follows the address period is regulated according to the existing drive current light emission level characteristic of the display element, as well as the level of the applied data signal, such that the effects of degradation are reduced. Degraded, dimmer, display elements will result in the pixel driving circuit energizing the display element for a period longer than that for an un-degraded, brighter, display element so that the average brightness can remain the same over an extended period of time of device operation.

The average light output in the drive period is dependent on the efficiency of the photodiode 34, which is highly uniform across the array of pixels, and is independent of the efficiency of the LED element. However, the output is dependent also on the threshold voltage of the drive TFT 22 and as this can vary from pixel to pixel display non-uniformity may occur. The pixel circuit of FIG. 2 also requires an efficient photodiode, typically an amorphous silicon pin photodiode and relatively high peak brightness to achieve reasonable average brightness. The decay of the charge stored on the storage capacitor 24 means also that the circuit operates at comparatively low brightness levels for most of the drive period. The circuit thus operates the LED at low efficiency and, therefore, can lead to increased ageing.

Figure 3:
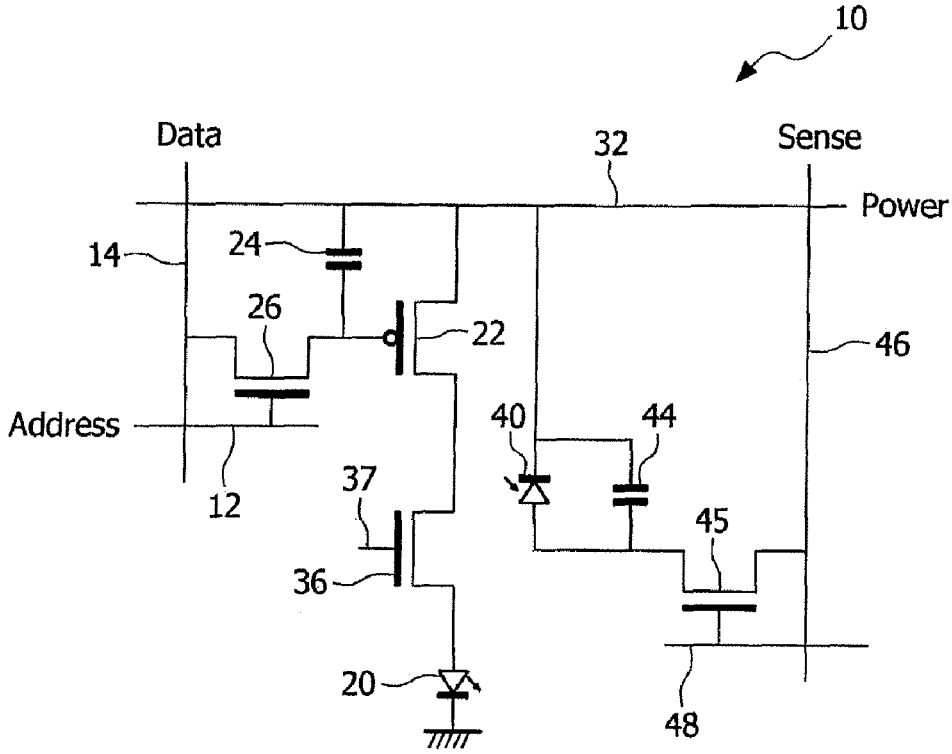
FIGS. 3, 4 and 5 illustrate schematically pixel circuits in embodiments of display device according to the present invention.

FIG. 3 illustrates an embodiment of pixel circuit 10 in a display device according to the present invention, and more particularly shows the basic lo principle of an external optical feedback approach used in the display device. In this pixel circuit a photosensitive device, here in the form of a photodiode 40, is again used to sense in the pixel light output from the display element 20. A storage capacitor 44, separate from the data signal storage capacitor 24, is connected across the photodiode 40 and accumulates charge produced as a result of light from the display element 20 falling on the photodiode 40. This storage capacitor 44 could perhaps be the intrinsic self-capacitance of the photodiode rather than a separate component. The amount of charge stored on the capacitor 24 is determined by the brightness of the pixel and varies accordingly.

The photodiode 40 is connected at its one side to a voltage supply, here the power line 32, and at its other side to a sense column line 46 via a switching TFT 45 whose operation is controlled by a control signal on a read out control line 48. This line 48 is shared by all pixels in the same row such that the switches 45 of all pixels in the row are operated simultaneously, while the sense line 46 is shared by all pixels in the same column. The charge accumulated by the capacitor 44 is read out through the line 46 upon operation of the switch 45 to a circuit outside the pixel array where it is measured and used in determining adjustments to data signals supplied to the pixels. It will be appreciated, therefore, that unlike the circuit of FIG. 2 the light output sensing part of the pixel circuit is not directly associated with the current source part of the circuit.

The pixel further includes an isolating TFT 36 connected between the drive TFT 22 and the display element 20 which can be opened, so as to isolate the display element 20 from the drive TFT 22, or closed, so as to allow the drive TFT to drive the display element and produce light output, by means of switching signals on the control line 48 connected to its gate, and shared by other pixels in the same row. The switch 45 enables the display element 20 to be maintained off during addressing of the pixel with a data signal so that no light is produced during this addressing period and no current is, therefore, drawn through the power line 32. This avoids the possibility of voltage drops to occurring along the line 32, and consequential crosstalk.

In a preferred mode of operation, with the display element 20 being energized by current supplied by the TFT 22 to generate light output, the photodiode 40 is isolated from the sense line 46, by maintaining the switching TFT 45 open, so as to allow charge resulting from illumination of the photodiode 40, to accumulate on the capacitor 44. In this way, a useful charge signal can be accumulated to make read-out simpler. Charge read-out, via the sense line 46, upon closing of the switching TFT 45, is preferable to current, or voltage, forms of signal read out as the sensitivity of an amplifier circuit connected to the line 46 for providing an indication of the level of the signal can be much greater and the dynamic range possible considerably larger.

The optical feedback information provided by the circuit of FIG. 3 enables compensation for the threshold voltage of the drive transistor, the mobility of the drive transistors and the ageing of the display element. As mentioned above, changes in threshold voltage will cause a shift in the data-voltage/brightness curve and can be adjusted using a shift in the data voltage. Changes in mobility and in LED efficiency result in a change of gradient of the curve, and require the data to be scaled. Changes in transistor mobility and LED efficiency act in the same way, and so it is their product that is important (so that an increase in mobility could exactly counter a decrease in LED efficiency). This product will be referred to below as "apparent mobility".

In order to provide an indication of the threshold voltage level and mobility of the drive TFTs 22 of pixels in the array, the display device may be driven so as to produce a series (at least two) of plain field images at different brightness levels. The signals stored on the photodiode storage capacitors 44 of the pixels for each plain field image would then be read out, by operating the switches 45, via the sense lines 46. Such read out would be for a row of pixels at a time, with the stored charges being read out for each row in sequence following one of the plain image fields, and then again following the next plain image field. From the data thereby obtained from each pixel, the mobility and the threshold voltage of the drive TFTs 22 of the pixel array can be calculated, as will be described in detail below. As these values do not lo vary significantly over time in the case of the drive TFTs 22 comprising polycrystalline silicon type TFTs, this operation would only need to be performed very occasionally or possibly only at the time of manufacturing the device. At suitable intervals over the life of the display device, for example each time the device is turned on, the device may be arranged to be operated with a threshold/mobility corrected plain field image and the sensed charge again read out. Any irregularities in the display image would then likely be due simply to the ageing effects of the EL material of the display elements and could be cancelled by appropriate image data correction. In the case of the drive TFTs 22 comprising amorphous silicon TFTs, whose characteristics may vary as a result of the level of driving of individual pixels over the device's lifetime, then such read out procedures preferably are performed more frequently.

Figure 4:
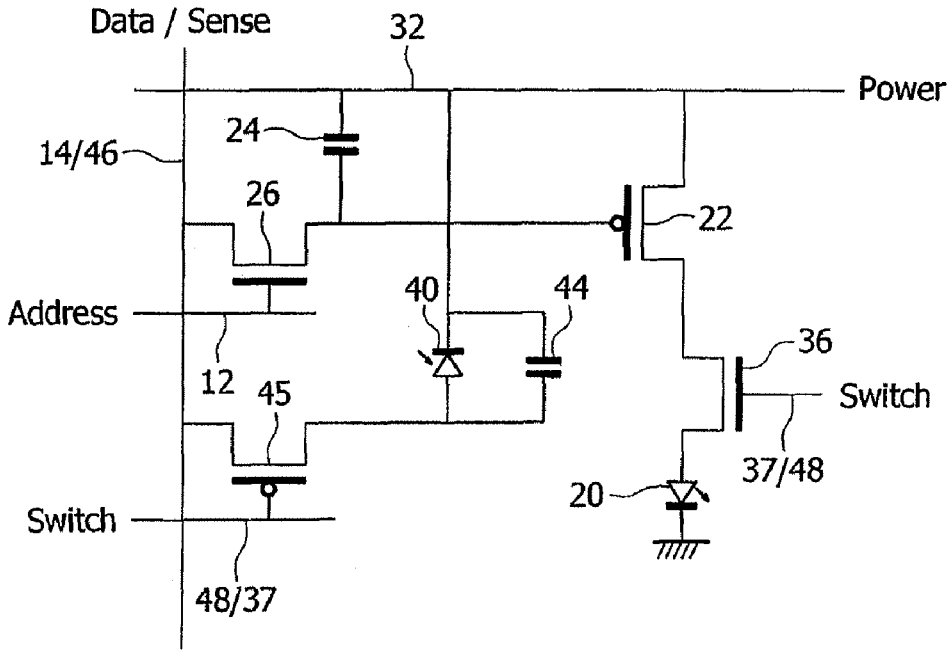

FIG. 4 shows schematically a preferred implementation of the pixel circuit of FIG. 3. Here, the same column line, 14/46, is used both for the supply of data signals and read out of charge signals from a pixel. Also, the same row address line is used for both the switching TFTs 45 and 36 of the pixels in a row. This enables an increase in the pixel aperture.

Figure 5:
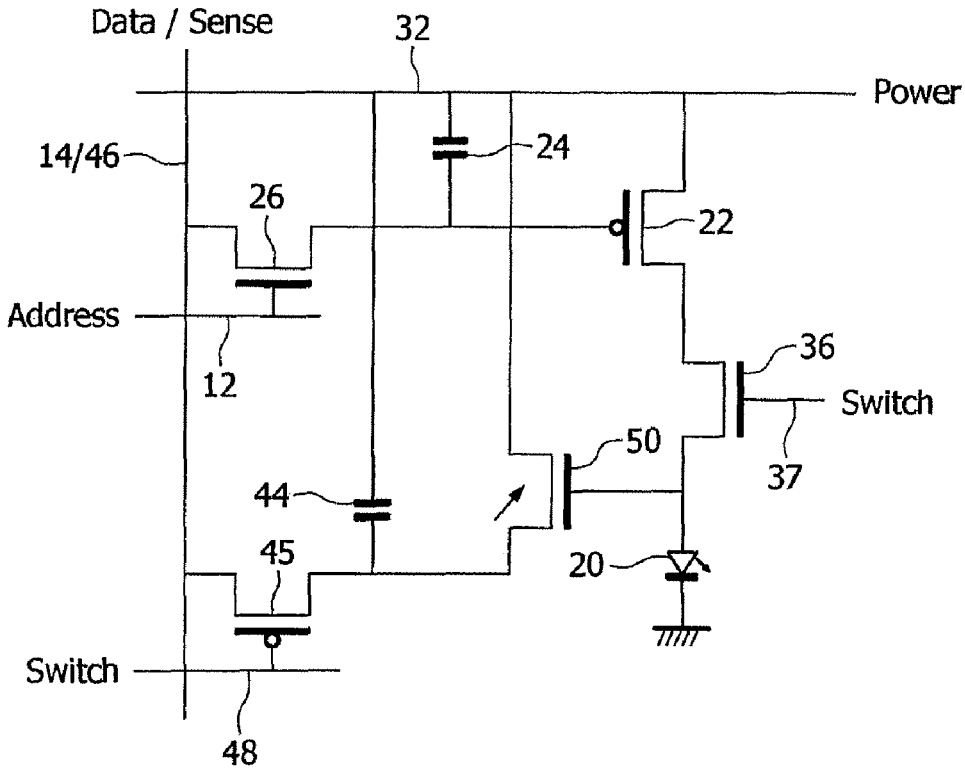

FIG. 5 illustrates a modified form of the pixel circuit of FIG. 3, in which a phototransistor 50 is used as a photosensitive device rather than the photodiode 40, the gate of the phototransistor 50 being coupled to the anode of the display element 20. The switches 45 are of opposite conductivity (p type) to the switches 36 (n type).

An example of method of operating the above described pixel circuit of FIG. 5 in order to capture optical feedback data for each pixel in the array will now be described. The display device is first operated by addressing the rows of pixels a row at a time, as usual, with appropriate data signals to produce a uniform grey level image from the pixels, with the switch TFTs 36 being turned off during addressing and then turned on in the subsequent display phase to allow energisation of the display elements and light emission. The switches 36 are then operated, via their switch control lines 37, so as to open, row by row. This has the effect of extinguishing each row of pixels in turn. At the same time as the switching of the switches 37 of each row, the switching TFTs 45 are operated, in complementary fashion, so as to connect the capacitors 44 of a row of pixels at a time to the shared column line 14/46. The stored charge can then be reset in preparation for a sensing procedure. This provides a reset operation for the capacitors 44 and gives a clear start point for a sense operation.

As each row ceases to be addressed, the EL display elements of the row of pixels are re-illuminated and charge integration in the storage capacitors 44 of those pixels begins. At the end of a predetermined illumination period, the display device is addressed, a row at a time, to turn off the display elements. In this way the end of charge integration can be set accurately without disturbing the stored charge. This charge may then be read out slowly in a following period.

It is possible to operate the display device and pixels in other ways to achieve the same function, and also to use alternative pixel circuit designs.

A number of methods of using the optical feedback information obtained as set out above will now be described.

In a first implementation, feedback information is obtained with the pixels operated over six frames (each frame being driven to a uniform image), so that optical feedback information is obtained for different display drive conditions. As set out below, these frames represent three different image brightness levels, and each with two different integrating periods. The six frames provide optical feedback information for the following conditions:

1. No pixel data (pixel off), with sampling after full frame time
2. Maximum pixel data (pixel full on), sampling after full frame time
3. Mid pixel data (pixel medium on), sampling after full frame time
4. No pixel data (pixel off), sampling after half frame time
5. Maximum pixel data (pixel full on), sampling after half frame time
6. Mid pixel data (pixel medium on), sampling after half frame time This set of six feedback data values for each pixel can be used to derive a compensation scheme for the pixel drive data which compensates for threshold voltage variations, mobility variations, display element ageing and also leakage current effects.

By considering the difference in optical output for the half frame duration and the full frame duration, the effects of leakage currents can be compensated as well as kickback effects. Thus, three new values are derived:

7. No pixel data (pixel off), difference between full and half frame time (value of 1-4)
8. Maximum pixel data (pixel full on), difference between full and half frame time (value of 2-5)
9. Mid pixel data (pixel medium on), difference between full and half frame time (value of 3-6)

The effect of external light on the photodiodes within the pixels can also be taken into account by using the optical feedback signal for no pixel data as a reference value. Thus, two new values are derived which represent the amount of charge stored on the capacitor:

Q1. Maximum pixel feedback data with compensation for ambient light (value of 8-7)

Q2. Mid pixel feedback data with compensation for ambient light (value of 9-7)

These calculations remove the effect of external light, but also remove further leakage current effects. The two values Q1 and Q2 respectively represent the stored charge at data values V1 and V2 with the compensations described above. The two values are charge values, derived from measurements of charge on the photodiode capacitor of each pixel. By enabling read-out in the charge domain, a high signal to noise ratio can be obtained, and charge can be allowed to build up to provide a good signal level.

For a transistor in saturation, the drain-source current is given by:

$$I_d = k\mu(V_d - V_t)^2$$

Taking into account the polymer LED efficiency ($\eta_{pl}$) and the photodiode efficiency ($\eta_{pd}$) the stored charge over a frame time ($T_{fr}$) will be equal to:

$$Q_{st} = T_{fr}.\eta_{pd}.\eta_{pl}.k\mu(V_d - V_t)^2$$

Substituting into this equation the two values obtained of charge stored on the capacitor:

$$Q_1 = K.\mu.\eta_{pl}(V_1 - V_t)^2$$

$$Q_2 = K.\mu.\eta_{pl}(V_2 - V_t)^2$$

K is a constant which takes into account the frame period and the photodiode efficiency, which are effectively constant. The equations include a term which is the product of the transistor mobility and the LED efficiency, which is the "apparent mobility" discussed above. This apparent mobility is essentially representative of the combined effects of LED ageing and transistor mobility variations. These two charge values enable the threshold voltage to be obtained:

$$V_t = ((V_1.\sqrt{Q_2}) - (V_2.\sqrt{Q_1}))/(\sqrt{Q_2} - \sqrt{Q_1})$$

The two values also enable the "apparent mobility" to be determined:

$$K.\mu.\eta_{pl} = Q_2/(V_2 - V_t)^2$$

Knowing the values of Q that were obtained from the entire display the mean value for the desired display brightness can be found. This can be used to calculate an entire gamma curve of Q for brightness.

The calculation of the parameters as explained above enables a correction scheme to be applied to the display. The data voltage to be used for a required value of Q (which represents a desired display brightness) can be calculated using the pixel characteristics as follows:

$$V_{data} = V_t + (Q_{desired}/K.\mu.\eta_{pl})^{1/2}$$

Thus, the data is shifted in response to the determined threshold voltage, and is scaled in response to the mobility/ageing "apparent mobility" parameter.

The correction scheme requires two optical feedback measurements for different display conditions, and these two degrees of freedom enable the threshold voltage and mobility/ageing parameter to be determined. The approach above uses six initial measurements to derive the required two feedback values more accurately and compensating for various effects. However, a simpler compensation scheme could be used to arrive at the required two feedback values, depending on the relative magnitude of the leakage currents, ambient light effects and kickback effect. For example three or four measurements may suffice.

For polysilicon drive transistors, the "apparent mobility" will vary over time, whereas the threshold voltage will remain relatively static.

As the threshold voltage can be considered static in this case, it can be determined during an initial setup procedure and then stored in a frame store. Only the apparent mobility will shift during use. In view of this, a simplified operation scheme can be devised as described below. This operation scheme provides the multiple frame measurements as described above during an initial setup procedure, or during manufacture, and then uses more basic charge measurements during use of the display in order to progressively compensate for the effects of LED ageing and mobility variations in the drive TFTs.

Thus, at manufacture, the display is operated and measured as outlined above to measure threshold voltage and apparent mobility (and optionally also to remove the effects of ambient light). The values are then stored, and after lo this time the threshold voltage shift value will never be altered.

At the start of use, the display will be uniform without apparent burn-in from LED differential ageing. During use, the LED will age and the apparent mobility values will become inaccurate. If the data is shifted to compensate for threshold voltage then a single measurement is enough to measure apparent mobility, and this can be used to scale the pixel drive data as appropriate. This can then be performed row by row during normal use.

This continuous measurement can be done in many ways, and one preferred implementation is described below.

A row of pixels (row "n") is initially reset so that its photo-sensor storage capacitor is reset. The display is then operated normally. Thus, data is loaded onto the pixels row by row and each row of pixels is illuminated simultaneously. The photo-sensors for row "n" will be sampling the brightness and storing charge on the photo-sensor storage capacitor.

When the display is addressed with the brightness data for the next frame, the charge data on the photo-sensor storage capacitor is maintained. In this way, the photo-sensor integrates over many frames, and a larger feedback signal can be obtained than for a single frame measurement.

The drive system can accurately predict the charge being stored on the pixels in row "n", because the system knows the efficiency of the photo-sensors and the brightness of each pixel on the row for all the frames that have passed since it was reset.

When the drive system determines that a pixel in row "n" will become saturated after the next frame (using the data for the following frame) it sends a read-out request. This saturation represents full charging or discharging of the photo-sensor storage capacitor. In response to the read-out request, at the end of the current frame the row "n" is then subject to a read-out operation.

The new feedback data obtained from row "n" is then used to calculate the new apparent mobility data for the pixels on that row and this data is then used to replace the data previously stored, which will either be the data stored at manufacture or the last update of the apparent mobility data.

The apparent mobility data can be derived from a single charge measurement by using the information from the initial setup measurements, and assuming some parameters have remained constant, such as the threshold voltage and photodiode efficiency.

After the collection of data for row "n" is complete, the photodiode capacitors for row "n+1" are then reset, and the operation can continue row by row. For each row in turn, the system calculates and integrate the data for the row to monitor when it is about to become saturated as above.

This monitoring scheme requires a resetting and read out pulse for one row of pixels at a time and at intervals of a number of frames. By charging the photodiode capacitance close to saturation, the number of read out operations is reduced to a minimum, and a larger quantity of charge is measured, which simplifies readout and data processing.

The read out operation can be carried out during the field blanking period between successive fields, so that the readout operation does not need to have any impact on the drive scheme timing. This is made possible by requiring only a single row pulse during the field blanking period, and feedback data is collected from different rows during different blanking periods. However, it is not essential to read-out in the field blanking period. The read-out operation is short, and therefore could be done at other times, depending on the drive scheme.

In a variation to this method, a single pixel can be selected, at random or sequentially, from the display. This pixel would then be reset, operated, monitored and read-out. This will entail resetting at least the whole row in which the pixel is situated, and reading out the whole row, but discarding the information from the other pixels on this row.

Figure 6:
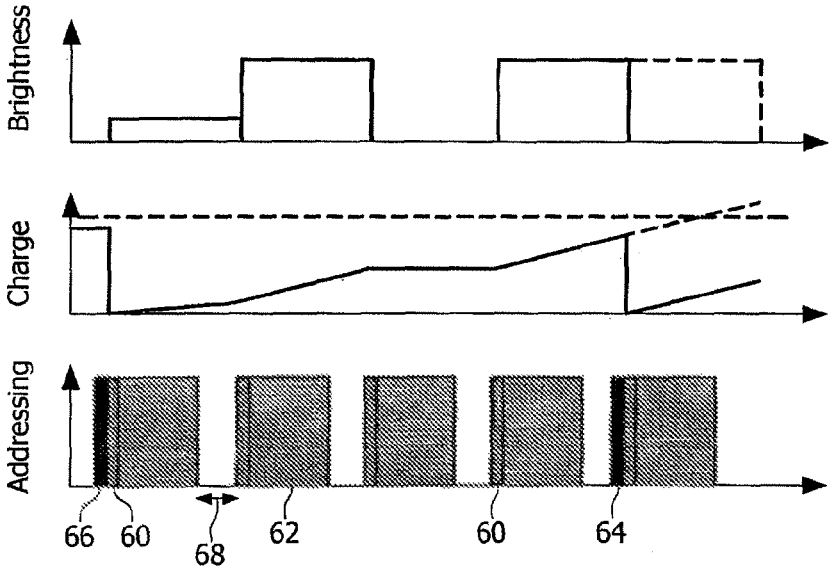
FIG. 6 is used to explain a method of capturing feedback information.

FIG. 6 is used to illustrate the method outlined above. The top plot shows the brightness of a pixel in a given row (row n) for several frames. The pixel is displaying video data that varies with time. The middle plot shows the charge that is accumulated on the photo-sensor storage capacitor over this time. The rate of increase of charge is dependent on the pixel brightness, as shown. In this plot, the dashed horizontal line represents the saturation charge of the pixel.

The bottom plot shows the addressing phases of the display. Each addressing phase includes a row address pulse for each row of pixels, and the timing of the row address pulse for row n is represented by the section 60, and the row address pulses for all other rows are timed in the section 62.

The pulse 64 shows the read-out pulse for row n, and the pulse 66 shows the read-out pulse for row n−1.

When one row is read-out, the next row is reset for measurement. Thus, the pulse 66 provides readout of row n−1 but also resets the photodiode storage capacitor for row n. Normal data is provided to row n over the first four frames shown, and the photo-sensor samples the light during each frame. The storage capacitor stores the charge and integrates this over several frames as explained above.

The drive system monitors approximately how much charge is stored on the photo-sensor storage capacitor of every pixel in row n. At the end of the fourth frame, assuming the pixel shown in FIG. 6 is the pixel with the highest stored charge, the drive system is able to predict that another frame would saturate the pixel. This saturation is shown as the dashed extrapolation line in the middle plot of FIG. 6, which crosses the saturation level. This triggers the read-out pulse 64 on row n. This read-out pulse can take place in a field blanking period 68 as shown, after the end of the addressing of all rows for that frame. This reads out the pixels on row n, and also row n+1 is then reset ready for integration and measurement over the next few frames.

Figure 7:
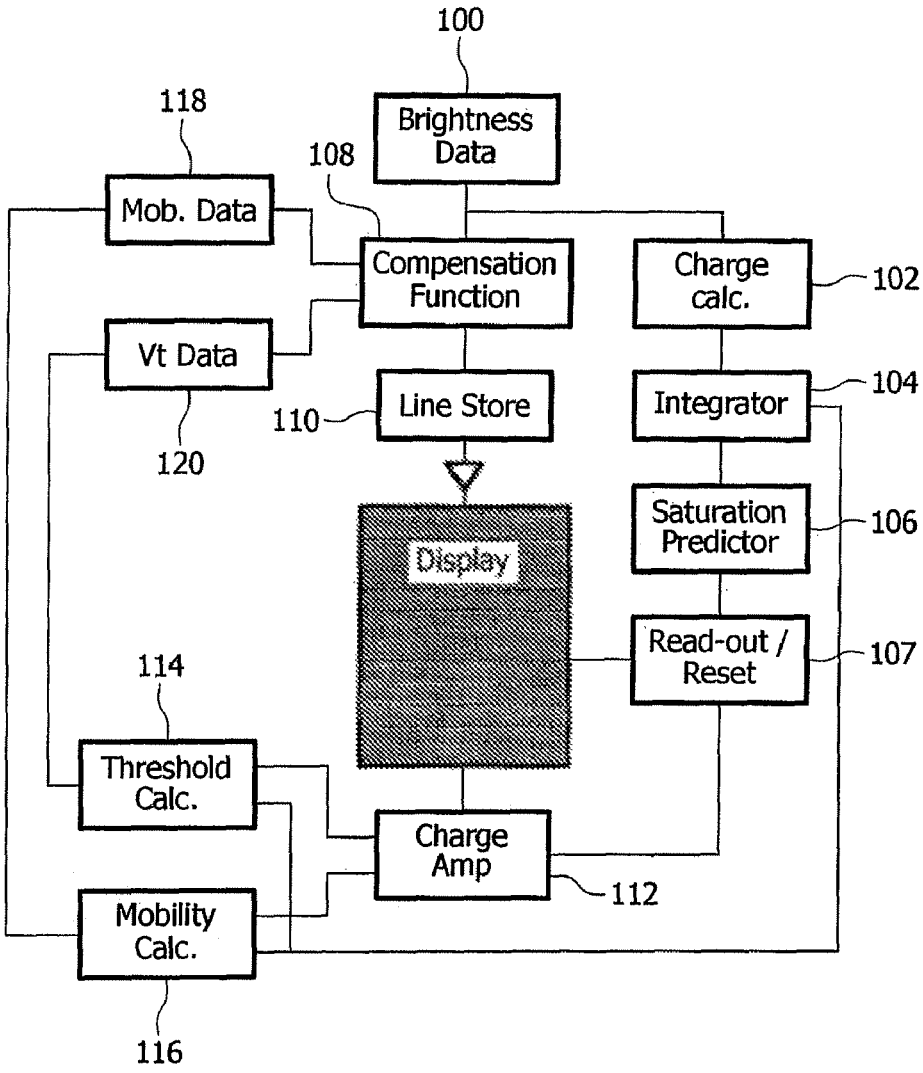
FIG. 7 shows a system for implementing the method explained with reference to FIG. 6.

FIG. 7 shows one possible architecture for a drive system.

The data for a pixel is input from the brightness data input 100. This data is provided to a charge calculation unit 102 which works out how much charge it would expect the photo-sensor to generate over the next frame.

This in turn is provided to an integrator 104, and the value this integrator stores is monitored by a saturation predictor 106 which estimates if any pixel will be saturated over the next frame. If so, the drive system will read-out the row at the next opportunity, and before the data is loaded onto the display, using the reset and read-out unit 107.

The data is also provided to a compensation function unit 108, which obtains the correct threshold voltage Vt and mobility data from the frame stores and corrects the data value to provide compensation.

This corrected data is provided to a line store 110 (or frame store depending on the addressing scheme) ready to be input to the display. If the row is not to the read-out then this data will pass to the display in the correct addressing scheme.

When a row is read-out, charge amplifiers 112 measure the data from all the pixels on the row, and pass this data to the Vt calculator 114 and mobility calculators 116. These take the measurement output data, either from manufacture or from use and the predicted integrated charge for that group of frames, and work out the mobility and threshold voltage of the pixels. These values are passed to respective frame stores 118, 120 and stored, ready for the subsequent compensation operations.

The functions performed by the system have been divided into units in FIG. 7. In fact, the calculations will all be implemented in a processor, and the diagram is purely for explanation. The data correction can take place fully in the digital domain, for example using separate drive chips.

The pixel circuits described above are intended to use polycrystalline silicon TFTs. Other variants suitable for using amorphous silicon TFTs are possible. In this case the sense read out scheme would be usable also to compensate for threshold voltage drift in the drive TFTs as well as LED material degradation.

Figure 8:
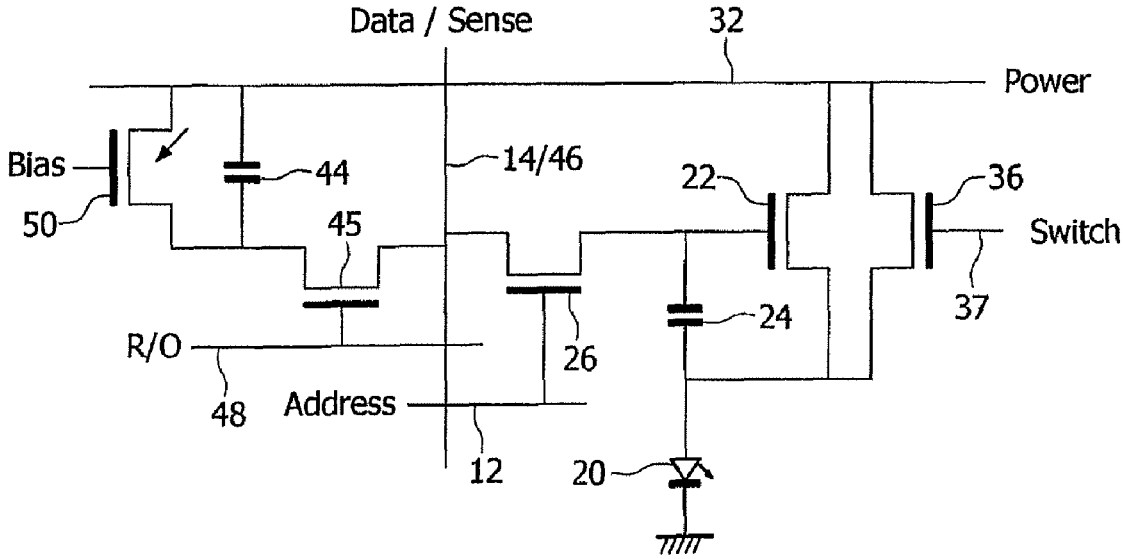
FIG. 8 shows an alternative pixel circuit in an embodiment of display device according to the present invention.

FIG. 8 shows a pixel circuit variant suitable for use with amorphous silicon technology. The switch line 37 controls the switch 36 which is here connected in parallel with the drive TFT 22 of the pixel rather than in series. Closure of the switch 36 pulls the anode of the display element 20 high, to the voltage of the power line 32, for the addressing phase so that the correct data voltage will be programmed across the drive TFT 22. The phototransistor 50 can be biased by connecting its gate to a suitable node in the pixel circuit, or possibly a pixel in the previous row, depending on the drive scheme used. The pixel then operates in similar manner to the previous embodiments. In this case, though, the display device is not corrected simply at the manufacturing stage, but periodically during use. the correction obtained should now be for both threshold voltage drift and LED material degradation.

Figure 9:
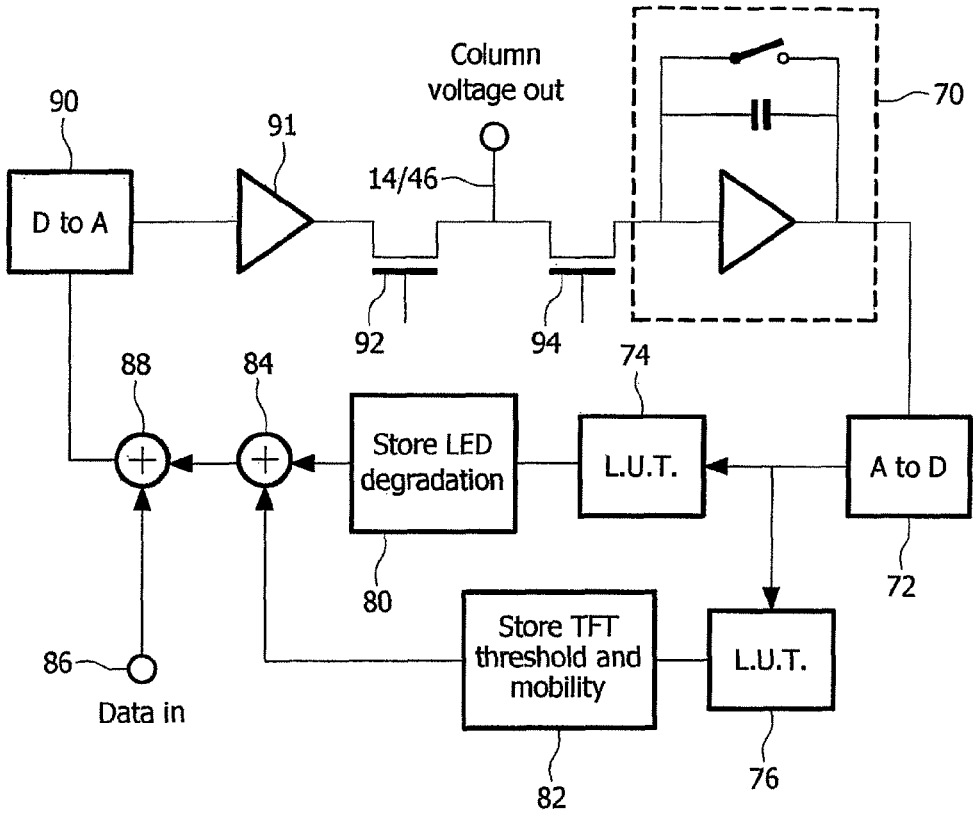
FIG. 9 shows schematically circuitry external to a pixel for adjusting data supplied to the pixel in an embodiment of display device according to the present invention.

FIG. 9 illustrates schematically an alternative arrangement of circuitry external to the pixels for performing the necessary corrections, and obtaining adjusted data signals for supply to the pixels, in a display device using any of the pixel circuit embodiments of FIGS. 3, 4, 5 and 8. This circuitry is preferably, and conveniently, incorporated in the column driver circuit 18.

When the display device is in its sense mode, with charge being read out via the sense line 46 or combined sense and data line 14/46, the charge for one pixel is measured using a charge sensitive amplifier 70. The output of the amplifier is supplied to an analogue to digital converter 72 and the resulting digital data indicative of the level of charge read out is stored in a corresponding look up table (LUT) 74, 76. During display device programming data relating to the threshold voltage and mobility of the drive TFTs 22 and the LED material degradation from respective stores 80 and 82 associated with the LUTs 74 and 76 are combined at 84 and added, at adder 88, to the pixel data, which is obtained in the column driver circuit 18 and supplied to an input 86 of this correction circuitry. The appropriately corrected data signal then output by the adder 88 is supplied, via a digital to analogue convertor 90 and buffer 9, to the data signal line 14 for supply to a pixel.

The read out of charge from the column line 14/46 and supply of data signals thereto is controlled by switches 92 and 94 which are operated alternately.

Each column of pixels is associated with a similar correction circuit.

In the case of an amorphous silicon TFT pixel circuit, there would only be one set of data, which contains offsets for both the threshold voltage and the LED material degradation.

Although examples of circuits using polycrystalline and amorphous silicon TFTs, microcrystalline silicon TFTs may also be used.

The photodiodes 40 are preferably pin devices.

From reading the present disclosure, other modifications will be apparent to persons skilled in the art. Such modifications may involve other features which are already known in the field of active matrix EL display devices and component parts therefor and which may be used instead of or in addition to features already described herein.

The invention claimed is:

1. An active matrix display device comprising an array of display pixels, each pixel comprising:

a current-driven light emitting display element (20);

a drive transistor (22) for driving a current through the display element;

a storage capacitor (24) for storing a pixel drive voltage to be used for addressing the drive transistor;

a light-dependent device (40) for detecting the brightness of the display element; and driver circuitry for providing data signals to the pixel external to the pixel array, wherein the driver circuitry further comprises processing means (114,116) for processing brightness signals from the light-dependent devices of each pixel, wherein the processing means is adapted to derive from a plurality of different brightness signals from each pixel a threshold voltage for the drive transistor of the pixel and information relating to the performance of the display element.

2. A device as claimed in claim 1, wherein each pixel further comprises a sense transistor (45) for controlling the coupling of the light-dependent device to a sense line (46).

3. A device as claimed in claim 1, wherein the light dependent device (40) is connected in series with the sense transistor (45) between a power supply line (32) and a sense line (46).

4. A device as claimed in claim 1, wherein the storage capacitor (24) is connected between the gate and source of the drive transistor (22).

5. A device as claimed in claim 1, wherein the brightness signals are in the form of a quantity of charge stored on a capacitor (44) associated with the light dependent device.

6. A device as claimed in claim 1, wherein the information relating to the performance of the display element comprises a parameter which takes account of the display element efficiency and the drive transistor mobility.

7. A device as claimed in claim 1, wherein the drive transistor (22) is connected between a power supply line (32) and the display element (20).

8. A device as claimed in claim 1, wherein the current-driven light emitting display element comprises an electroluminescent display element.

9. A device as claimed claim 1, wherein the driver circuitry is operable during a setup process to drive the display elements of each pixel to a plurality of different predetermined drive levels, and the processing means is operable to process brightness signals from the light-dependent devices of each pixel for each of the plurality of different predetermined drive levels.

10. A device as claimed in claim 9, wherein the driver circuitry is operable during a setup process to drive the display elements of each pixel to an off state, a full brightness state and an intermediate state.

11. A device as claimed in claim 10, wherein the driver circuitry is operable during a setup process to drive the display elements of each pixel to a plurality of different predetermined drive levels twice, and the processing means is operable to process brightness signals from the light-dependent devices of each pixel for each of the plurality of different predetermined drive levels for two different time periods of illumination.

12. A device as claimed in claim 11, wherein the processing means derives difference data from pairs of data for each pixel for each of the plurality of different predetermined drive levels.

13. A device as claimed in claim 12, wherein the processing means derives further difference data from the difference data in order to compensate for ambient illumination of the light dependent devices.

14. A device as claimed in claim 13, wherein the processing means derives, for each pixel, threshold voltage data and mobility data from the further difference data.

15. A device as claimed in claim 1, wherein the driver circuitry is operable during use of the display to perform a reset operation (64,66) of the light dependent device of a pixel or row of pixels, and subsequently to control the processing means to process brightness signals from the light-dependent devices of the pixel or row of pixels.

16. A device as claimed in claim 15, wherein the driver circuitry is operable to control the processing means to process brightness signals from the light-dependent devices of the pixel or row of pixels shortly before the light dependent device of a pixel or of a pixel in the row reaches a saturation condition.

17. A device as claimed in claim 16, wherein the driver circuitry is operable to control the processing means to process brightness signals from the light-dependent devices of the pixel or row of pixels a plurality of frames after the reset operation.

18. A device as claimed in claim 1, further comprising a memory structure having a first memory means (120) for storing threshold voltage information for the drive transistor of each pixel and having a second memory means (118) for storing mobility information for each pixel.

19. A device as claimed in claim 18, wherein the drive transistor (22) is a p-type thin film transistor, and wherein data is provided once only to the first memory means during a setup procedure, and data in the second memory means is updated during use of the display.

20. A device as claimed in claim 18, wherein the drive transistor (22) is an n-type amorphous silicon thin film transistor, and wherein data is provided once only to the second memory means during a setup procedure, and data in the first memory means is updated during use of the display.

21. A method of driving an active matrix display device comprising an array of display pixels each comprising a drive transistor (22), a current-driven light emitting display element (20) and a light-dependent device (40) for detecting the brightness of the display element, the method comprising:

driving the display elements (20) of each pixel to a plurality of different predetermined drive levels, and processing brightness signals from the light-dependent devices of each pixel for each of the plurality of different predetermined drive levels; and deriving threshold voltage and information relating to the performance of the display element from the brightness signals.

22. A method as claimed in claim 21, wherein the method comprises:

during a setup process, deriving the threshold voltage and performance information from the brightness signals; and during use of the display, processing brightness signals from the light-dependent devices of each pixel to update the performance information and thereby compensate for differential pixel ageing.

23. A method as claimed in claim 22, wherein during the setup process the display elements of each pixel are driven to an off state, a full brightness state and an intermediate state.

24. A method as claimed in claim 23, wherein during the setup process the display elements of each pixel are driven to a plurality of different predetermined drive levels twice, and brightness signals from the light-dependent devices of each pixel are processed for each of the plurality of different predetermined drive levels for two different time periods of illumination.

25. A method as claimed in claim 24, further comprising deriving difference data from pairs of data for each pixel for each of the plurality of different predetermined drive levels.

26. A method as claimed in claim 25, comprising deriving further difference data from the difference data in order to compensate for ambient illumination of the light dependent devices.

27. A method as claimed in claim 26, further comprising deriving, for each pixel, threshold voltage data and mobility data from the further difference data.

28. A method as claimed in claim 21, wherein the pixel drive data is modified taking into account the most recent threshold voltage and mobility information.

29. A method as claimed in claim 21, comprising, during use of the display, performing a reset operation of the light dependent device of a pixel or row of pixels, and subsequently processing brightness signals from the light-dependent devices of the pixel or row of pixels.

30. A method as claimed in claim 29, wherein the reset operation is carried out during a field blanking period of the display.

31. A method as claimed in claim 29, wherein brightness signals from the light-dependent devices of the pixel or row of pixels are processed shortly before the light dependent device of a pixel or of a pixel in the row reaches a saturation condition.

32. A method as claimed in claim 31, wherein a saturation condition is predicted by estimating the expected condition of the light sensing devices of the pixels in response to the display data since the reset operation and the display data of the next frame.

33. A method as claimed in claim 31, wherein brightness signals from the light-dependent devices of the pixel or row of pixels are processed a plurality of frames after the reset operation.

34. A method as claimed in claim 21, further comprising storing threshold voltage information for the drive transistor of each pixel in one memory are and storing mobility information for each pixel in a second memory area.

35. A method as claimed in claim 34, wherein the drive transistor is a p-type thin film transistor, and wherein data is provided once only to the first memory area during a setup procedure, and data in the second memory means is updated during use of the display.

36. A method as claimed in claim 34, wherein the drive transistor is an n-type amorphous silicon thin film transistor, and wherein data is provided once only to the second memory area during a setup procedure, and data in the first memory area is updated during use of the display.

* * * * *